United States Patent [19]

Koshikawa et al.

[11] Patent Number: 4,522,251

[45] Date of Patent: Jun. 11, 1985

[54] METHOD OF INCREASING CASTING WIDTH FOR A SLAB DURING A CONTINUOUS CASTING OPERATION

[75] Inventors: Takao Koshikawa; Tsunehiro Ueda; Tadao Ozeki, all of Chiba, Japan

[73] Assignee: Kawasaki Steel Corporation, Kobe, Japan

[21] Appl. No.: 458,646

[22] Filed: Jan. 17, 1983

Related U.S. Application Data

[63] Continuation-in-part of Ser. No. 56,092, Jul. 9, 1979, abandoned, and Ser. No. 276,715, Jun. 23, 1981, abandoned.

[51] Int. Cl.[3] ..... B22D 11/04

[52] U.S. Cl. ..... 164/491; 164/436

[58] Field of Search ..... 164/416, 436, 488, 491

[56] References Cited

U.S. PATENT DOCUMENTS

| | | | |
|---|---|---|---|
| 3,261,058 | 7/1966 | Tisdale | 249/202 |
| 3,612,150 | 10/1971 | Rossi | 164/436 |
| 3,643,724 | 2/1972 | Lee | 249/202 |
| 4,022,265 | 5/1977 | Takahash et al. | 164/436 |
| 4,207,941 | 6/1980 | Shrum | 164/418 |
| 4,299,266 | 10/1981 | Hashio et al. | 164/491 |

FOREIGN PATENT DOCUMENTS

| | | | |
|---|---|---|---|
| 53-45782 | 12/1978 | Japan | 164/436 |
| 33871 | 3/1980 | Japan | 164/491 |

*Primary Examiner*—Nicholas P. Godici
*Assistant Examiner*—Richard K. Seidel
*Attorney, Agent, or Firm*—Balogh, Osann, Kramer, Dvorak, Genova & Traub

[57] ABSTRACT

The width of a slab can be easily increased during a continuous casting operation by a simple method, wherein casting of a molten steel is temporarily stopped during the continuous casting operation, the narrow side of a casting mold is moved to a predetermined width, corresponding to the increased width to be of the slab, to form a space between the narrow side of the mold and the solidified shell of a slab, a closing member having a width 1-5 mm smaller than the increased width of the slab, and a cooling and sealing material are inserted into the space to form a clearance of 1-5 mm between the closing member and the narrow side of the mold, and the casting of the molten steel is again started.

5 Claims, 14 Drawing Figures

METHOD OF INCREASING CASTING WIDTH FOR A SLAB DURING A CONTINUOUS CASTING OPERATIONBACKGROUND OF THE INVENTION

This application is a continuation-in-part application of 056,092, filed July 9, 1979, now abandoned, application Ser. No. 276,715, filed June 23, 1981 which has become abandoned.

FIELD OF THE INVENTION

The present invention relates to a method of increasing the casting width for a slab during a continuous casting operation, and particularly to a method of enlarging the width of a slab in an easy and safe manner during a very short period of time of interruption of the continuous casting operation.

DESCRIPTION OF THE PRIOR ART

When a molten steel is formed into a slab through a continuous casting, the width of the slab is contantly corresponding to the predetermined dimension of the casting mold. Therefore, when it is intended to produce slabs having different widths, the following procedure is generally carried out. That is, after a casting is completed, the resulting slab is drawn out, the set width of the casting mold is increased, a dummy bar is again inserted, and then the next casting is started. However, this procedure requires generally a long time of 1–2 hours until the next casting is started. After a casting is completed, the width of a casting mold is increased and then a dummy bar is inserted. This is one of the causes of decreasing the efficiency of continuous casting process.

It has been variously attempted to increase continuously the casting width in order to obviate the above-described drawbacks without the reinsertion of a dummy bar. For example, there has been known a method, wherein the narrow side of a casting mold is moved in such a very slow rate that it does not cause breakage of the shell of slab formed by the solidification of molten steel in the casting mold. However, in this method, it is necessary to move slowly the narrow side of a casting mold, and therefore a tapered slab is formed over several meters along the longitudinal direction of the slab in order to increase the slab width by several tens of centimeters. This tapered slab has different widths along the longitudinal direction of the slab, and it is troublesome to produce a slab having a constant width by cutting off the tapered portion, and the yield is low. In another method illustrated in FIG. 1, casting is temporarily stopped, the narrow side 1 of a casting mold is moved backwardly by means of a driving gear 6, a plate 3 connected to another driving gear 2 arranged on the lower end of the narrow side 1 is moved forwardly, a cooling and sealing material 5 consisting of, for example, scrap is inserted in a space between the narrow side 1 of the casting mold and the solidified shell 4 of the slab, and then the casting is again started. However, this method has the following drawbacks. A high cost is required for arranging the above-described devices at the lower end of the casting mold. A cooling plate or a support roll, which is arranged on the lower end of a casting mold extending downwardly to several tens of centimeters in order to hold a slab and to prevent the bulging of the slab in the ordinary continuous casting installation cannot be arranged in the apparatus of this method, and the slab is apt to bulge on the narrow side. As a result, the shape of the slab is poor, and cracks are apt to be formed on the surface or in the interior of the slab. Moreover, in this method, the plate 3 which supports the cooling and sealing material 5 must be moved backwardly by means of the driving gear 2 just before the drawing out of the slab following the casting. In this case, the cooling and sealing material 5 falls down the bottom portion of the solidified shell of a slab and the solidified shell in the increased width portion is sometimes broken, and the molten steel breaks out. Further, there has been known a method, wherein a plate is arranged in a space between a previously moved narrow side of a casting mold and a slab, a molten steel is cast and then the slab is drawn out. However, in this method, the plate is apt to be deformed and moved due to the formation of mold taper and the oscillation movement at the drawing out of the slab, and there is a risk of breakout of the molten steel from the bottom of the increased width portion of the slab.

SUMMARY OF THE INVENTION

The present invention aims to obviate the above-described drawbacks and provides a method capable of increasing the width of a slab in a simple manner during the continuous casting operation.

Hence, the main feature of the present invention is the provision of a method of increasing the width of a slab in a continuous casting. The method includes the steps as follows: Providing a tapered casting mold having a narrow side; pouring molten steel into the mold to produce a continuously cast slab; stopping temporarily the pouring of the molten steel and the casting of the slab; moving the narrow side of the mold to a predetermined width, corresponding to the predetermined increased width of the slab, so as to form a space between the narrow side of the mold and the solidified shell of the slab; inserting into the space, a closing member provided with a curved metal plate and suspenders, the metal plate having a length 0–2 mm shorter than the thickness of the slab, and a width 1 –5 mm smaller than the increased width of the slab at the location of the closing member, but being substantially the same as the increased width of the slab at the lower end of the mold; engaging the suspenders with the upper edge of the solidified shell of the slab; filling a cooling and sealing material in the space formed on the closing member, up to a height of one-half of the suspended length of the closing member, so as to form a clearance of 1–5 mm between the closing member and the narrow side of the mold; and starting again the pouring of the molten steel and casting of the slab followed by the drawing out thereof.

DESCRIPTION OF THE PREFERRED EMBODIMENTS

Figure 2A:
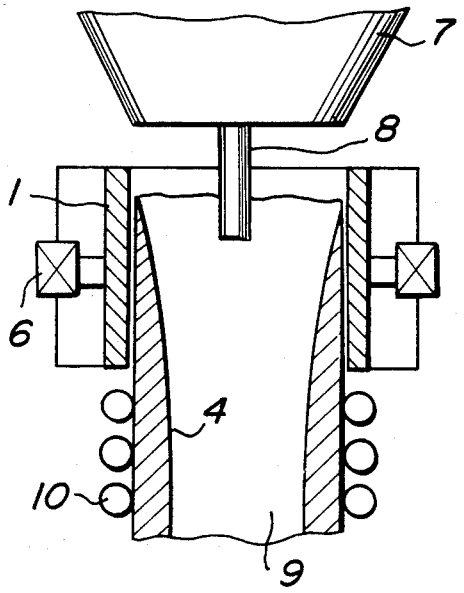
FIGS. 2*a*, 2*b* and 2*c* are diagrammatic cross-sectional views for explaining stepwisely the method of increasing the casting width according to the present invention during a continuous casting operation.
Figure 2B:
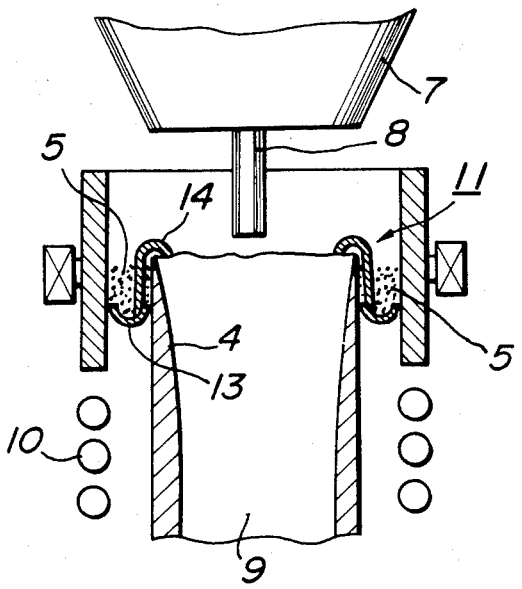
Figure 2C:
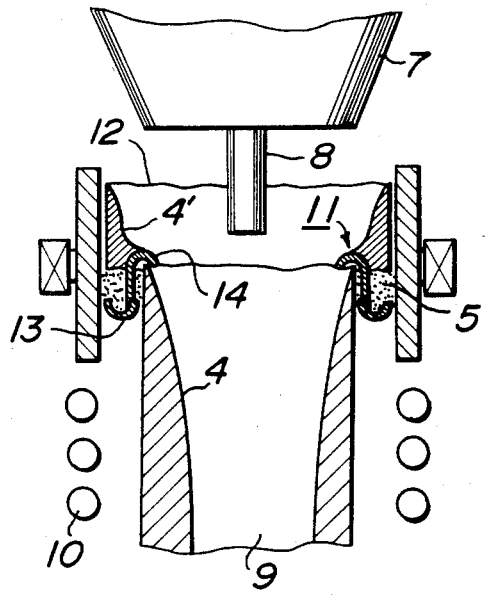

FIGS. 2*a*, 2*b* and 2*c* explain diagrammatically and stepwisely the method of increasing the casting width according to the present invention.

Figure 1:
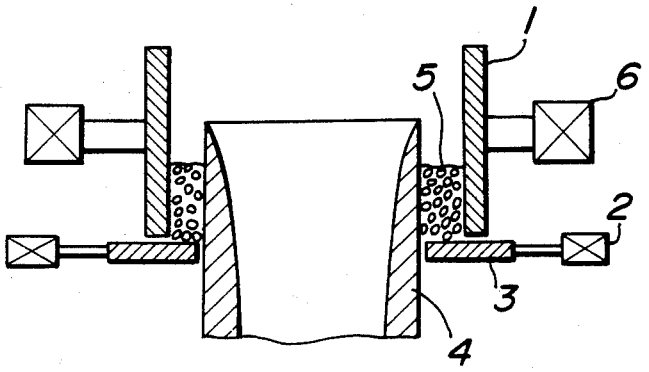
PRIOR ART FIG. 1
FIG. 1 is a diagrammatic cross-sectional view for explaining a conventional method of increasing the casting width during a continuous casting operation as mentioned above.

In FIGS. 2*a*, 2*b* and 2*c*, the numeral 1 represents the narrow side of a casting mold, the numeral 4 represents the solidified shell of a slab 9, the numeral 5 represents a cooling and sealing material, and the numeral 6 represents a driving gear for the narrow side of the casting mold. These members are the same as those used in the conventional method illustrated in FIG. 1. However, the method of the present invention is carried out without the use of a plate 3 and a driving gear 2 for the plate.

The space between the narrow side of the casting mold and the solidified shell of the slab must be filled with a certain means. The inventors have found a simple means for filling the space. As a result, the inventors have found a method not having the above-described drawbacks and capable of increasing the width of a slab in a high workability and in a very simple manner with the use of the conventional continuous casting apparatus as such.

The method of increasing the casting width of a slab during the continuous casting according to the present invention will be explained hereinafter referring to FIGS. 2*a*–2*c*.

FIG. 2*a* illustrates a state of a casting mold before the width thereof is enlarged in the conventional continuous casting. FIG. 2*b* illustrates a state of the casting mold, wherein the narrow sides of the mold are moved backwardly and a cooling and sealing material is filled in a space between the narrow side of the mold and the solidified shell of a slab. FIG. 2*c* illustrates a state of the casting mold, wherein the casting is again started after the casting width of the mold has been increased.

In the state of casting a slab 9 having an original certain width illustrated in FIG. 2*a*, a molten steel charged in a turndish 7 is poured through a nozzle 8 into a casting mold formed by a pair of wide sides and a pair of narrow sides 1 and 1 arranged therebetween to produce the slab 9. In FIG. 2*a*, the numeral 10 represents a support roll which supports the narrow side surface of the slab.

Figure 3A:
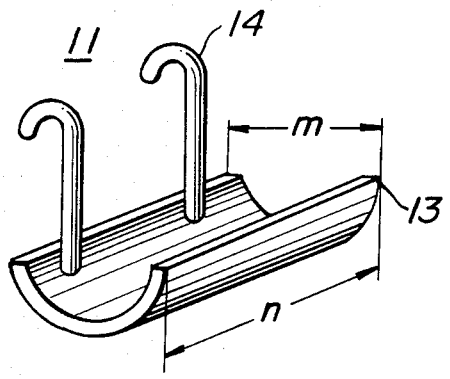
FIGS. 3*a* and 3*b* are perspective views of closing members applicable to the method of the present invention.
Figure 3B:
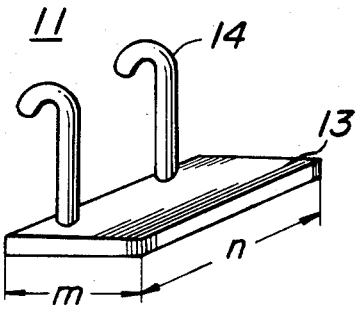

The casting is temporarily stopped in the state of FIG. 2*a*, and then the resulting slab is drawn out up to a position lower than the lower end of the nozzle, the narrow side 1 of the casting mold is moved backwardly up to a distance corresponding to a predetermined dimension of the casting mold, a metal fitting for receiving a cooling and sealing material, that is, a closing member 11 illustrated in FIG. 3*a* or 3*b*, which consists of a metal plate 13 and metal rods 14 fixed thereto as suspenders, is inserted into a space between the narrow side 1 of the casting mold and the solidified shell 4 of the slab so as to suspend the closing member 11 therefrom, and then a cooling and sealing material 5 is filled in a space on the closing member 11 between the narrow side 1 of the casting mold and the solidified shell 4 of the slab as illustrated in FIG. 2*b*. As will be explained below, the preferred width of the closing member 11 is 1–5 mm smaller than the width of the increased width of the slab, so that the step of filling the cooling and sealing material in the space on the closing member 11 forms a clearance of 1–5 mm between the narrow side of the mold and the closing member (see FIGS. 6*a*–6*c*, 7 and 8). The cooling and sealing material 5 is filled in the aforesaid space up to a height of one-half of the suspended length of the closing member 11.

Then, the casting is again started as illustrated in FIG. 2*c* to produce a slab 12 having a width different from that of the originally cast slab 9 (i.e., increased width).

Figure 4A:
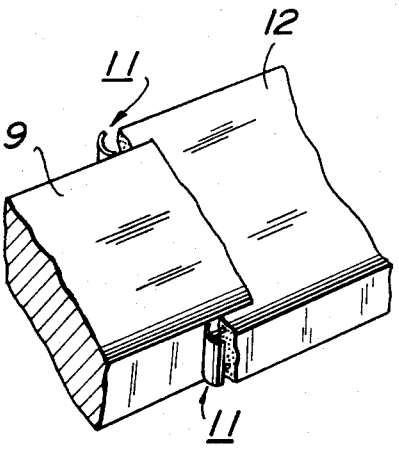
FIGS. 4*a* and 4*b* are perspective views of slabs produced in the continuous casting method of the present invention and having different widths.
Figure 4B:
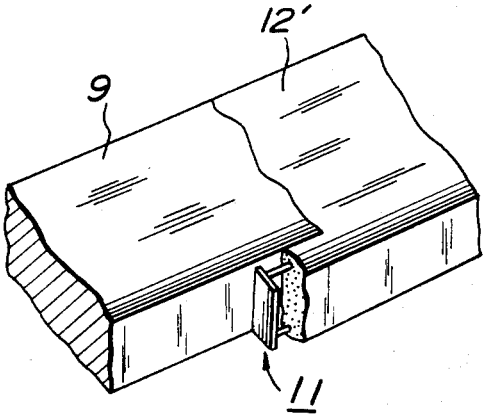

Further to be noted in FIGS. 2*c*, 4*a* and 4*b* is that in accordance with the present invention, the upper edge of the solidified shell 4 of slab 9 is held or is completely bonded (as a whole) to newly cast slab 12.

In the present invention, the closing member 11 has a very important role. Therefore, the closing member 11 will be explained in detail hereinafter. The closing member 11 may consist of a curved steel plate 13 having a semi-circular shape in cross-section and worked into a given dimension and round steel rods 14 having a diameter of about 5–30 mm and welded to the plate as illustrated in FIG. 3*a*. The rods 14 engage the upper edge of the solidified shell 4 of a slab 9 and suspend the steel plate 13. The width m of the curved steel plate is preferred to be smaller by 1–5 mm than the width to be increased of the slab (refer to FIG. 3), and the length n thereof is preferred to be narrower by 0–2 mm than the thickness of the slab. The reason for a narrow gap or clearance being formed between the slab and the casting mold is to enable the slab to be smoothly drawn out even when a mold taper is formed and an oscillation movement occurs.

The narrow side of a casting mold has generally a taper of about 0.8–1.5%, and the width of a slab at the lower end of the mold is about 6–20 mm smaller than the width of the slab at the upper end of the mold, although this difference is varied corresponding to the slab width to be cast and the tapered amount.

Figure 6A:
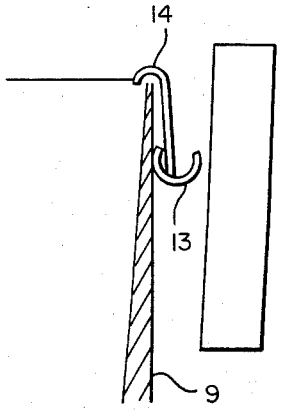
FIGS. 6*a*, 6*b*, 6*c*, 7 and 8 are diagrammatic cross-sectional views for explaining stepwisely the method of the present invention, especially as it relates to the formation of a clearance between the curved metal plate and the narrow side of the mold, and the passage of the curved metal plate through the mold.

The curved metal plate 13 is suspended between the solidified shell 4 of a slab 9 and the casting mold and is kept there in such a way that there is a certain clearance between the side portion of the curved metal plate 13 and the narrow side of the casting mold, as illustrated in FIG. 6*a*.

Figure 6B:
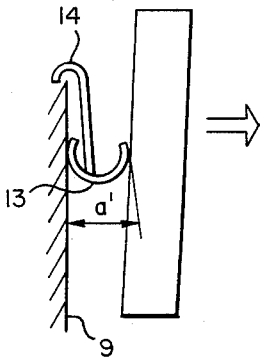
Figure 6C:
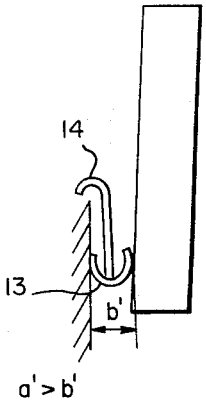
Figure 7:
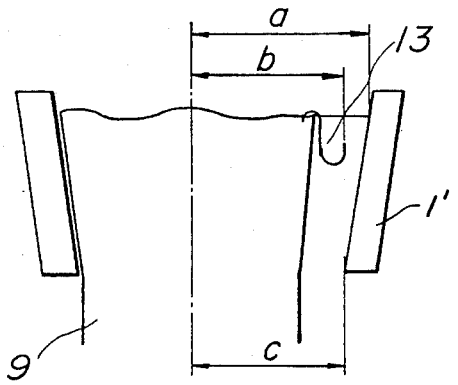
Figure 8:
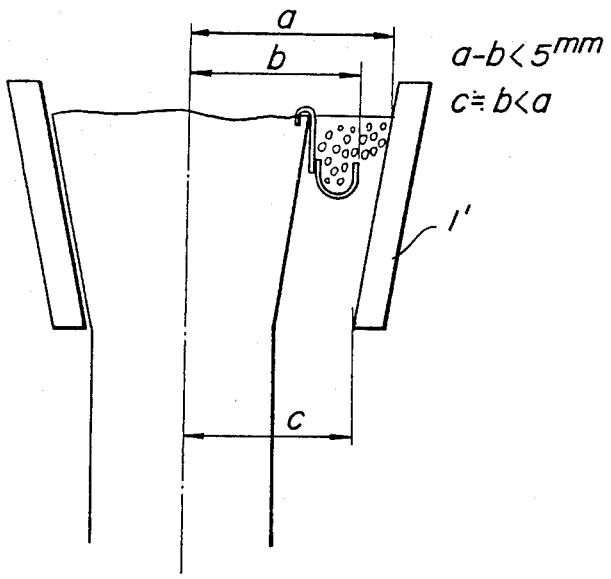

When the curved metal plate 13 is in contact with the narrow side of the mold, during the drawing out of the slab, and following the downward movement of the curved metal plate (together with the drawn out slab) relative to the narrow side of the mold, from its originally set position (during the casting operation) (as illustrated in FIGS. 6*b* and 6*c*), the compression force acting on the metal plate causes a decrease in its radius of curvature. Although the compression force acts on the metal plate, the plate itself deforms, and its original width m can be changed into a smaller width, but there are neither deformation nor breakage of the solidified shell of the slab nor is there any leakage of the sealing material or molten steel. On the other hand, when a conventional flat metal plate is used, if the plate is pressed between the solidified shell of a slab and the side of the mold, not only the plate cannot be deformed, but it inclines or corrugates, causing the leakage of sealing material and deformation and breakage of the solidified shell of the slab. FIGS. 7 and 8 further explain and illustrate the method of the present invention, and in particular, the relationship between the closing member metal plate 13 and the narrow side of the tapered mold (1') and the clearance formed between them.

As shown in FIG. 7:

a is the distance between the center of the original slab and the end of the slab after the slab width has been increased, at the location of a closing plate;

b is the distance between the center of the original slab and the outer end of the closing plate at the location of the closing plate; and c is the distance between the center of the original slab and the end of the slab after the slab width has been increased, at the lower end of a mold.

The following relationship between a, b and c must be satisfied: $c=b<a$.

When a closing member 11 is inserted into the space between the narrow side wall 1 of the mold 1' and the slab g, a clearance or gap having a dimension of (a–b) or 1–5 mm is formed between the curved metal plate 13 and the side of the mold because a is larger than b, as explained above.

This clearance or gap as such is maintained during the entire process and even after the casting is again started. The reason why the gap is formed is to enable the closing metal plate 13 to pass freely through the lower end portion of the mold. The curved metal plate 13 has a semi-circular shape in cross-section, and, therefore, if the width of the closing plate should be somewhat larger than the gap formed between the slab 9 and the narrow side wall of the mold 1' at the lower end of the mold (by any chance), the metal plate should be in contact with the mold 1' (in the case where the casting is again started and the closing plate is moved downwardly together with the slab 9), the closing plate itself can reduce its width in the radial direction, without causing breakage of the solidified shell of the slab or leakage of molten steel. This is the most important feature of the present invention.

FIG. 8 illustrates the state of the tapered casting mold 1' before the casting is again started, which state has been formed by moving the narrow side of the mold 1' to a predetermined width, inserting in the space formed, a closing metal plate 13 and filling a sealing material in the space on the closing metal plate 13.

In the present invention, the gap or clearance between the closing metal plate 13 and the narrow side of the mold 1' is smaller than 5 mm, as explained above (in FIG. 7, $(a-b)<5$ mm). Any conventional sealing and cooling material may be used, such as scrapes having an average diameter of 3–10 mm. Therefore, when a sealing material is filled in the space formed on the closing metal plate, leakage of molten steel or dropping of the sealing material does not occur.

Figure 5:
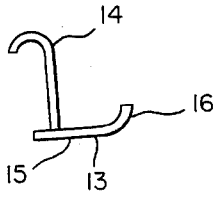
FIG. 5 is a side elevation view of another embodiment of the closing member applicable to the method of the present invention.

The closing member 11 may also consist of a curved metal (e.g., steel) plate 13 having a flat portion 15 connected to a curved up tip portion 16, the latter portion being formed only at the contact point with the casting mold, as illustrated in FIG. 5.

In the present invention, a curved steel plate having a semi-circular shape in cross-section is preferably used. Such curved steel plate is produced by cutting a steel pipe. Therefore, the radius R of curvature of the semi-circular shape is varied depending upon the amount of the casting width to be increased. Accordingly, in the present invention, the radius R of curvature of the semi-circular shape is not limited to any particular value. In general, a curved steel plate having a radius of curvature of 5–200 mm in cross-section is preferably used. (Practically the amount of the casting width to be increased to 250 mm at the maximum. In this case, a curved steel plate is produced from a steel pipe having a radius of 130 mm). It should be stressed though that whenever a metal plate or steel plate is curved, the object of the present invention can be attained.

Similarly, the thickness of the curved steel plate 13 is not limited to any particular value since the curved steel plates are produced from pipes, the thickness of which varies in correspondence to their radius. In general, when the thickness of the curved steel plate is about 1.0–10 mm, the object of the present invention can be attained.

In the present invention, the above-described round steel rod having a diameter of 5–30 mm is preferably used as the suspender 14. However, the suspender is not limited thereto, and a suspender having other shapes or made of other materials can be used. For example, the suspender may be formed of a metal pipe or a refractory material. FIG. **3*b* illustrates another embodiment of the closing member 11, wherein a flat steel plate 13 is used as the metal plate. The dimension of the flat steel plate illustrated in FIG. 3*b* is the same as that of the curved steel plate illustrated in FIG. 3*a*. The closing member 11** can be made of not only steel but also metals other than steel and refractory materials.

The following examples are given for the purpose of illustration of this invention and are not intended as limitations thereof.

EXAMPLE 1

A raw material steel for casting a thick sheet, which contained 0.14% of C, 0.20% of Si, 0.80% of Mn and other impurity elements, was firstly cast into a slab having a thickness of 200 mm and width of 1,400 mm. During the course of the casting, the casting width for the slab was increased by 120 mm in each side, and a slab having a thickness of 200 mm and a width of 1,640 mm was produced successively.

In this example, the slab having a width of 1,400 mm was firstly produced by a casting, the casting was temporarily stopped, each of the narrow sides of the casting mold was moved backwardly by 125 mm, a closing member 11 illustrated in FIG. **3*a*, which consisted of a curved steel plate 13 having a semi-circular shape in cross-section and having a width m of 118 mm and a length n of 198 mm, and round steel rods 14 fixed to the plate 13 and having a diameter of 20 mm and a length of 200 mm was suspended from the upper edge of each narrow side of the casting mold was moved forwardly by 5 mm, whereby the casting width of the mold was increased in both narrow sides thereof so as to produce the slab having a thickness of 200 mm and an increased width of 1,640 mm. Then, a cooling and sealing material 5 consisting of nail scrap was filled up to a height of about 100 mm in spaces between the solidified shell 4 of the slab 9 and the narrow sides of the casting mold, and casting of the raw material steel from the turndish 7** was again started.

It took about 90 seconds in the above-described operation. The slab width was increased stepwisely in the same manner as described above, and three kinds of slabs having different widths were produced by merely inserting originally a dummy bar. FIG. **4*a* illustrates the seam of the slab 9 having an original width and the slab 12** having an increased width in both sides produced in this example.

EXAMPLE 2

A raw material steel for casting a cold rolled steel sheet, which contained 0.04% of C, 0.30% of Mn, 0.035% of Al and other impurity elements, was firstly cast into a slab having a thickness of 260 mm and a width of 960 mm. During the course of the casting, the casting width for the slab was increased by 80 mm in only one side, and a slab having a thickness of 260 mm and a width of 1,040 mm was produced successively.

In this example, the slab having a width of 960 mm was firstly produced by a casting, the casting was temporarily stopped, only one of the narrow sides 1 and 1 of the casting mold was moved backwardly by about 85 mm, a closing member 11 illustrated in FIG. 3*b*, which consisted of a flat steel plate 13 having a thickness of 5 mm, a width m of 78 mm and a length n of 258 mm and round steel rods 14 having a diameter of 15 mm and a length of 200 mm and fixed thereto, was suspended from the upper edge of the short side of the solidified shell 4 of the slab 9, which was faced to the backwardly moved narrow side of the casting mold, and the backwardly moved narrow side of the casting mold was moved forwardly by about 5 mm, whereby the casting width of the mold was increased in one narrow side thereof so as to produce a slab having a thickness of 260 mm and a width of 1,040 mm. Then, a cooling and sealing material 5 consisting of nail scrap was filled up to a height of about 100 mm in a space between the solidified shell 4 of the slab 9 and the narrow side 1 of the casting mold, and the casting of the raw material steel from the turndish 7 was again started.

It took about 75 seconds in the above-described operation. The slab width was increased stepwisely in the same manner as described above, and four kinds of slabs having different widths were produced by merely inserting originally a dummy bar. FIG. 4*b* illustrates the seam of the slab 9 having an original width and the slab 12' having an increased width in one side produced in this example.

EXAMPLE 3

A raw material steel for casting a thick sheet, which contained 0.13% of C, 0.18% of Si, 0.75% of Mn and other impurity elements, was firstly cast into a slab having a thickness of 200 mm and a width of 1,600 mm. During the course of the casting, the casting width for the slab was increased by 200 mm in only one side, and a slab having a thickness of 200 mm and a width of 1,800 mm was produced successively.

In this example, the slab having a width of 1,600 mm was firstly produced by a casting, the casting was temporarily stopped, only one of the narrow sides 1 and 1 of the casting mold was moved backwardly by 200 mm, and a closing member 11 illustrated in FIG. 3*a*, which consisted of a curved steel plate 13 having a semi-circular shape in cross-section and having a width m of 195 mm and a length n of 198 mm and round steel rods 14 having a diameter of 20 mm and a length of 200 mm and fixed to the plate 13, was suspended from the upper edge of the narrow side of the solidified shell 4 of the slab 9, which was faced to the backwardly moved narrow side of the casting mold, whereby the casting width of the mold was increased in one narrow side thereof so as to produce a slab having a thickness of 200 mm and a width of 1,800 mm. Then, a cooling and sealing material 5 consisting of nail scrap was filled up to a height of about 100 mm in a space between the solidified shell 4 of the slab 9 and the narrow side 1 of the casting mold, and the casting from the turndish 7 was again started.

As described above, according to the present invention, a conventional casting installation is directly used, and the width of a slab can be increased stepwisely in a simple manner by the use of an easily available material and by stopping the casting for several minutes.

In the conventional continuous casting method, the operation efficiency cannot be improved mainly due to the reason that casting is stopped in every casting lot, the width of the casting mold is increased and then a dummy bar is again inserted. This operation requires 1–2 hours. On the contrary, in the present invention, the time required for this operation can be omitted, and the operation efficiency of the continuous casting installation is remarkably increased, and further the tapered slab is not formed at all. Therefore, the yield in the continuous casting according to the present invention is higher by 0.5–2% than the yield in the conventional continuous casting. Moreover, according to the present invention, since a large amount of raw material steel can be continuously cast by one time of insertion of a dummy bar, the amount of refractory material to be used for the turndish is 20–40% smaller than that in the conventional continuous casting. Further, according to the present invention, slabs composed of different kinds of steels and having different widths can be produced by a continuous casting.

What is claimed is:

1. A method of increasing the width of a slab during a continuous casting operation, comprising:

providing a tapered casting mold having a narrow side;

pouring molten steel into the mold to produce a continuously cast slab;

stopping temporarily the pouring of the molten steel and the casting of the slab;

moving the narrow side of the mold to a predetermined width corresponding to a predetermined increased width of the slab, so as to form a space between the narrow side of the mold and the solidified shell of the slab;

inserting into the space, a closing member provided with a curved metal plate and suspenders, the metal plate having a length 0–2 mm shorter than the thickness of the slab, and a width 1–5 mm smaller than the increased width of the slab at the location of the closing member, but being substantially the same as the increased width of the slab at the lower end of the mold;

engaging the suspenders with the upper edge of the solidified shell of the slab;

filling a cooling and sealing material in the space formed on the closing member, up to a height of one-half of the suspended length of the closing member, and forming a clearance of 1–5 mm between the closing member and the narrow side of the mold; and starting again the pouring of the molten steel and the casting of the slab, followed by the drawing out thereof.

2. A method according to claim 1, wherein said curved metal plate has a semi-circular shape in cross-section.

3. A method according to claim 2, wherein said curved metal plate is a curved steel plate.

4. A method according to claim 1, wherein said metal plate comprises a flat portion and a curved tip portion, said tip portion being formed at the point of contact of said metal plate with the narrow side of the casting mold.

5. A method according to claim 3, wherein each of the suspenders is a round steel rod having a diameter of 5–30 mm.

* * * * *